US012276280B2

(12) United States Patent
Suhara et al.

(10) Patent No.: US 12,276,280 B2
(45) Date of Patent: Apr. 15, 2025

(54) UNIAXIAL ECCENTRIC SCREW PUMP WITH RADIAL ADJUSTMENT OF THE STATOR

(71) Applicant: HEISHIN Ltd., Hyogo (JP)

(72) Inventors: Nobuhisa Suhara, Shiga (JP); Takashi Sato, Shiga (JP)

(73) Assignee: HEISHIN Ltd., Hyogo (JP)

( * ) Notice: Subject to any disclaimer, the term of this patent is extended or adjusted under 35 U.S.C. 154(b) by 74 days.

(21) Appl. No.: 17/641,768

(22) PCT Filed: Jun. 29, 2020

(86) PCT No.: PCT/JP2020/025449
§ 371 (c)(1),
(2) Date: Dec. 21, 2023

(87) PCT Pub. No.: WO2021/059641
PCT Pub. Date: Apr. 1, 2021

(65) Prior Publication Data

US 2024/0125321 A1 Apr. 18, 2024

(30) Foreign Application Priority Data

Sep. 24, 2019 (JP) ..... 2019-172529

(51) Int. Cl.
*F04C 2/107* (2006.01)
*F04C 15/00* (2006.01)

(52) U.S. Cl.
CPC ..... *F04C 2/1075* (2013.01); *F04C 2/1073* (2013.01); *F04C 15/0046* (2013.01); *F04C 2240/10* (2013.01); *F04C 2240/802* (2013.01)

(58) Field of Classification Search
CPC .. F04C 2/1075; F04C 2/1073; F04C 15/0046; F04C 2240/10; F04C 2240/802; F01C 21/102
See application file for complete search history.

(56) References Cited

U.S. PATENT DOCUMENTS 8,439,659 B2 * 5/2013 Loeker ..... F04C 2/1075 418/48
10,760,570 B2 * 9/2020 Voit ..... F04C 2/1075
(Continued)

FOREIGN PATENT DOCUMENTS

JP S57-17189 B2 4/1982
JP 2017-525895 A 9/2017

OTHER PUBLICATIONS

Foreign Patent and Machine Translation for CN 106605066 A; First Inventor: Ofermayr; Title: Eccentric-screw Pump; Published: Apr. 26, 2017. (Year: 2017).*
(Continued)

*Primary Examiner* — Mary A Davis
(74) *Attorney, Agent, or Firm* — Renner, Otto, Boisselle & Sklar, LLP

(57) ABSTRACT

A uniaxial eccentric screw pump includes: a stator having a through hole 8*a* whose inner surface is formed in a female screw shape; a rotor that is a male screw shaft body inserted into the through hole of the stator; a plurality of shims that are arranged on a radially outside of the stator in a range from one end to the other end of the stator, are in surface contact with an outer surface of the stator, are capable of compressing the stator by moving radially inward with respect to the stator, and have, on an outer surface, an inclined surface gradually inclined radially inward or outward toward one end; and an adjustment member that is movable in an axial direction with respect to the stator and has a pressing part that can press the inclined surface of each of the shims.

9 Claims, 10 Drawing Sheets

(56) References Cited

U.S. PATENT DOCUMENTS

2017/0268505 A1 9/2017 Dicks
2017/0306760 A1* 10/2017 Overmeier ..... F04C 2/1073

OTHER PUBLICATIONS

International Search Report for corresponding Application No. PCT/JP2020/025449, mailed Aug. 11, 2020.

* cited by examiner

UNIAXIAL ECCENTRIC SCREW PUMP WITH RADIAL ADJUSTMENT OF THE STATOR

This is a national phase application in the United States of International Patent Application No. PCT/JP2020/025449 with an international filing date of Jun. 29, 2020, which claims priority of Japanese Patent Application No. 2019-172529 filed on Sep. 24, 2019 the contents of which are incorporated herein by reference.

TECHNICAL FIELD

The present invention relates to a uniaxial eccentric screw pump.

BACKGROUND ART

A uniaxial eccentric screw pump having an adjustable stator in which an interference is automatically adjusted by an actuator is conventionally known (see, for example, JP 2017-525895).

A uniaxial eccentric screw pump in which a clamping allowance is adjusted by providing a spiral slit in a stator to form a plate part, attaching a plate-like rib thereto, and clamping a pressing ring with a bolt to press the plate part via the rib is known (see, for example, JP 57-17189).

However, in the former pump, the inclined surface (tension surface) of the stator casing is pressed by the inclined surface (tension surface) of the tension member at a position protruding from both end parts of the stator. Therefore, it is difficult for the stator casing to uniformly press the entire stator in the longitudinal direction toward the inner diameter side. Due to this, variations in the axial direction occur in the clamping state, and the fluid cannot be smoothly conveyed, or the stator easily vibrates when the rotor rotates in the stator, which causes pulsation when a fluid is conveyed. These become more conspicuous as the stator is longer.

On the other hand, in the latter pump, the shape of the stator becomes complicated, and processing becomes difficult and expensive. Since a plurality of adjustment bolts press the pump body at a plurality of locations via the plate member, it is not easy to adjust the clamping force, and it is difficult to obtain a uniform clamping state as a whole.

An object of the present invention is to provide a uniaxial eccentric screw pump that can uniformly and reliably compress the entire stator toward the inner diameter side while the uniaxial eccentric screw pump can be manufactured at low cost with a simple configuration.

Means for Solving the Problems

An aspect of the present invention provides, as a means for solving the above problems, a uniaxial eccentric screw pump including: a stator having a through hole whose inner surface is formed in a female screw shape; a rotor that is a male screw shaft body inserted into the through hole of the stator; a plurality of shims that are arranged on a radially outside of the stator in a range from one end to an other end of the stator, are in surface contact with an outer surface of the stator, are capable of compressing the stator by moving radially inward with respect to the stator, and have, on an outer surface, an inclined surface gradually inclined radially inward or outward toward one end; and an adjustment member that is movable in an axial direction with respect to the stator and has a pressing part that can press the inclined surface of each of the shims.

According to this configuration, the clamping state of the rotor by the stator can be adjusted with a simple and inexpensive configuration in which only the shims and the adjustment member are added. Moreover, the shims are arranged in a range from one end to the other end of the stator, and the inclined surface is pressed by the pressing part of the adjustment member. Therefore, the shim itself can also be guided by the adjustment member, and the shim can uniformly press the entire stator toward the inner diameter side. Due to this, the clamping state of the rotor by the stator can be made uniform.

It is preferable to further include an outer cylinder that guides each of the shims in a state of blocking the shims from moving in a direction other than a radial direction.

According to this configuration, it is possible to prevent the shim from being displaced in the circumferential direction with respect to the stator and to obtain a more favorable clamping state.

Preferably, the stator is formed to have a polygonal cross section, the shim includes at least one planar part in surface contact with the outer surface of the stator, and the planar part of any of the shims is in surface contact with all outer surfaces of the stator.

According to this configuration, it is possible to stabilize the pressing state of the shim with respect to the stator, and to prevent the positional displacement in the circumferential direction.

Preferably, the inclined surface of the shim includes a first inclined surface of an outer surface on one end side and a second inclined surface of an outer surface on an other end side, and the adjustment member includes a first guide part disposed on one end side of the stator, a second guide part disposed on an other end side of the stator, and an adjustment part that adjusts an interval between the first guide part and the second guide part.

According to this configuration, the interference on both end sides of the stator can be adjusted simultaneously or individually by adjusting the interval between the first guide part and the second guide part.

Preferably, the adjustment part simultaneously moves the first guide part and the second guide part in opposite directions to uniformly bring the first guide part and the second guide part into and out of contact with each other.

According to this configuration, the first guide part and the second guide part can be simultaneously moved by the adjustment part to adjust the interval between them. By simultaneously moving the first guide part and the second guide part, it is possible to simultaneously press the first inclined surface and the second inclined surface of the shim and to uniformly press the shim on both end sides. This can move the shim toward the inner diameter side in a well-balanced manner.

Preferably, the adjustment part includes a bolt and a nut that clamp the first guide part and the second guide part.

According to this configuration, the interval between the first guide part and the second guide part can be adjusted only by changing the clamping position of the bolt and the nut.

Preferably, the adjustment part is tubular, is disposed on the radially outside of the stator, and includes a right-handed screw and a left-handed screw on an inner peripheral surface of both end parts, and the first guide part and the second guide part include a screw part screwed into the right-handed screw and the left-handed screw on an outer surface of the first guide part and the second guide part, respectively.

According to this configuration, when the adjustment part is rotated, the screwing positions of the first guide part and the second guide part can be changed simultaneously, and the first guide part and the second guide part can be uniformly brought into and out of contact with each other.

It is preferable to include a rotational position regulation portion that regulates a rotational position of the adjustment part.

According to this configuration, after the rotational position of the adjustment part is adjusted, the rotational position regulation portion can prevent positional displacement in the rotational direction.

Preferably, the rotational position regulation portion includes a rotation part that circumferentially rotates the adjustment part, and a positioning part that positions the rotation part with respect to the first guide part or the second guide part.

According to this configuration, after the rotation part rotates the adjustment part to adjust the interval between the first guide part and the second guide part, the positioning part positions the rotation part, whereby the interval between the first guide part and the second guide part can be prevented from being changed.

Preferably, the positioning part includes a positioning projection part formed on the rotation part, and a positioning recess part formed at a position corresponding to a rotation angle of the rotation part from a reference position in the first guide part or the second guide part, where the positioning projection part is engaged with or disengaged from the positioning projection part.

According to this configuration, the rotation angle of the rotation part can be set to a preset value. Due to this, the interval between the first guide part and the second guide part, i.e., a pressing amount of the stator by the shim can be set to a desired value.

According to an aspect of the present invention, it is possible to provide a simple and inexpensive configuration in which only shims and an adjustment member are added to an existing configuration. The shims are arranged in a range from one end to the other end of the stator, and are configured to move toward the inner diameter side by the pressing part of the adjustment member pressing the inclined surface of the shims. Therefore, the entire stator can be uniformly pressed toward the inner diameter side, and the clamping state of the rotor by the stator can be made uniform.

BRIEF DESCRIPTION OF THE DRAWINGS

The foregoing and the other features of the present invention will become apparent from the following description and drawings of an illustrative embodiment of the invention in which.

MODE FOR CARRYING OUT THE INVENTION

Embodiments of the present invention will be described below with reference to the accompanying drawings. It should be noted that the following description is essentially illustrative only and is not intended to limit the present invention, its applications, or its uses.

First Embodiment

Figure 1:
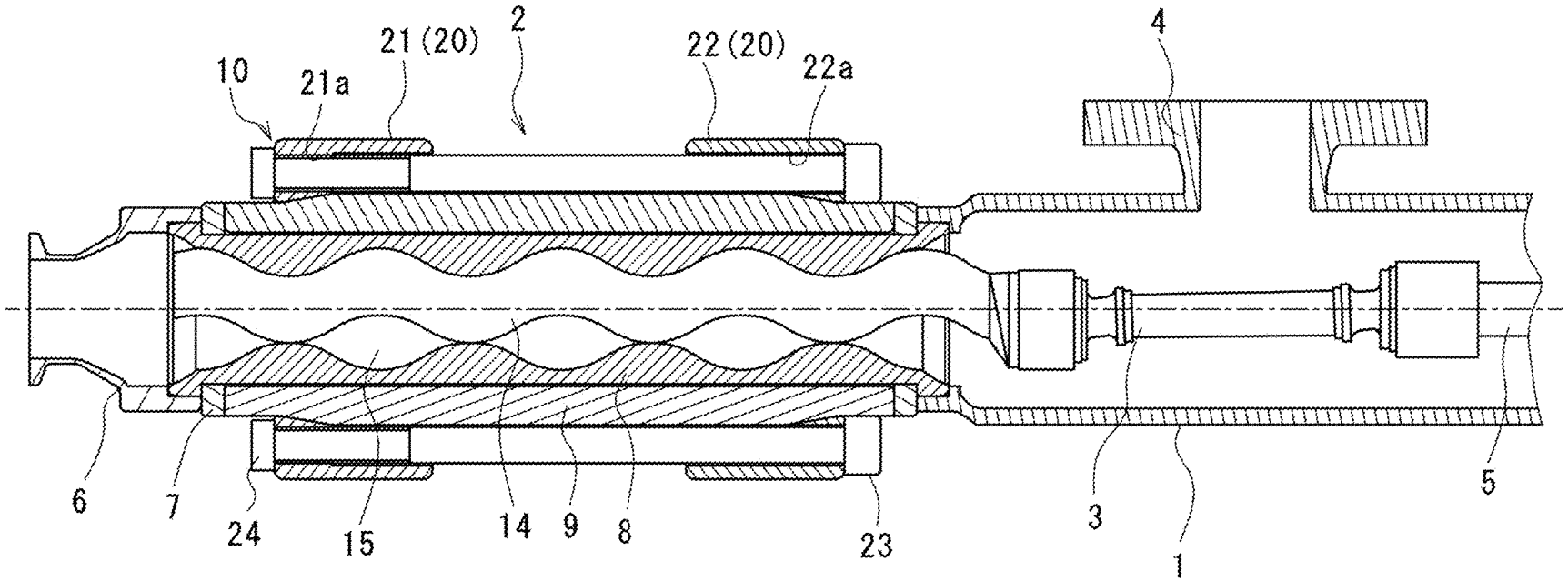
FIG. 1 is a cross-sectional view of a uniaxial eccentric screw pump according to the present embodiment.

As shown in FIG. 1, the uniaxial eccentric screw pump according to the first embodiment includes a drive machine (not illustrated) on one end side of a casing 1, and a pump body 2 on the other end side. The casing 1 includes a metal material formed into a tubular shape, and a joint part 3 is disposed inside the casing 1. A connection pipe 4 is connected to the casing 1, and a fluid can be supplied from a tank or the like (not illustrated). A drive shaft 5 extending from a drive source is coupled to one end of the joint part 3. A rotor 14 to be described later is connected to the other end of the joint part 3. An end stud 6 is provided at a tip end of the pump body 2, and constitutes an outlet of the fluid from the pump body 2.

Figure 2:
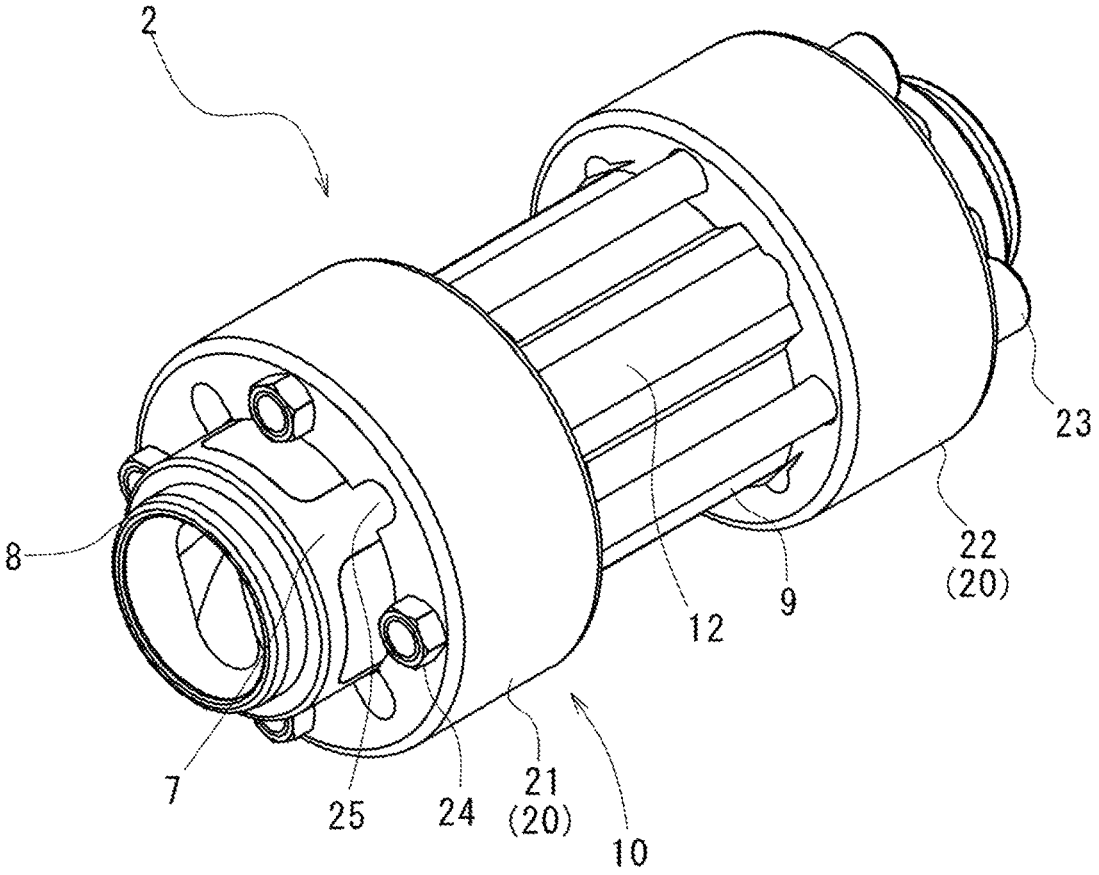
FIG. 2 is a perspective view of a pump body according to a first embodiment used in the uniaxial eccentric screw pump of FIG. 1.

As shown in FIG. 2, the pump body 2 includes an outer cylinder 7, a stator 8, a shim 9, and an adjustment member 10.

Figure 3:
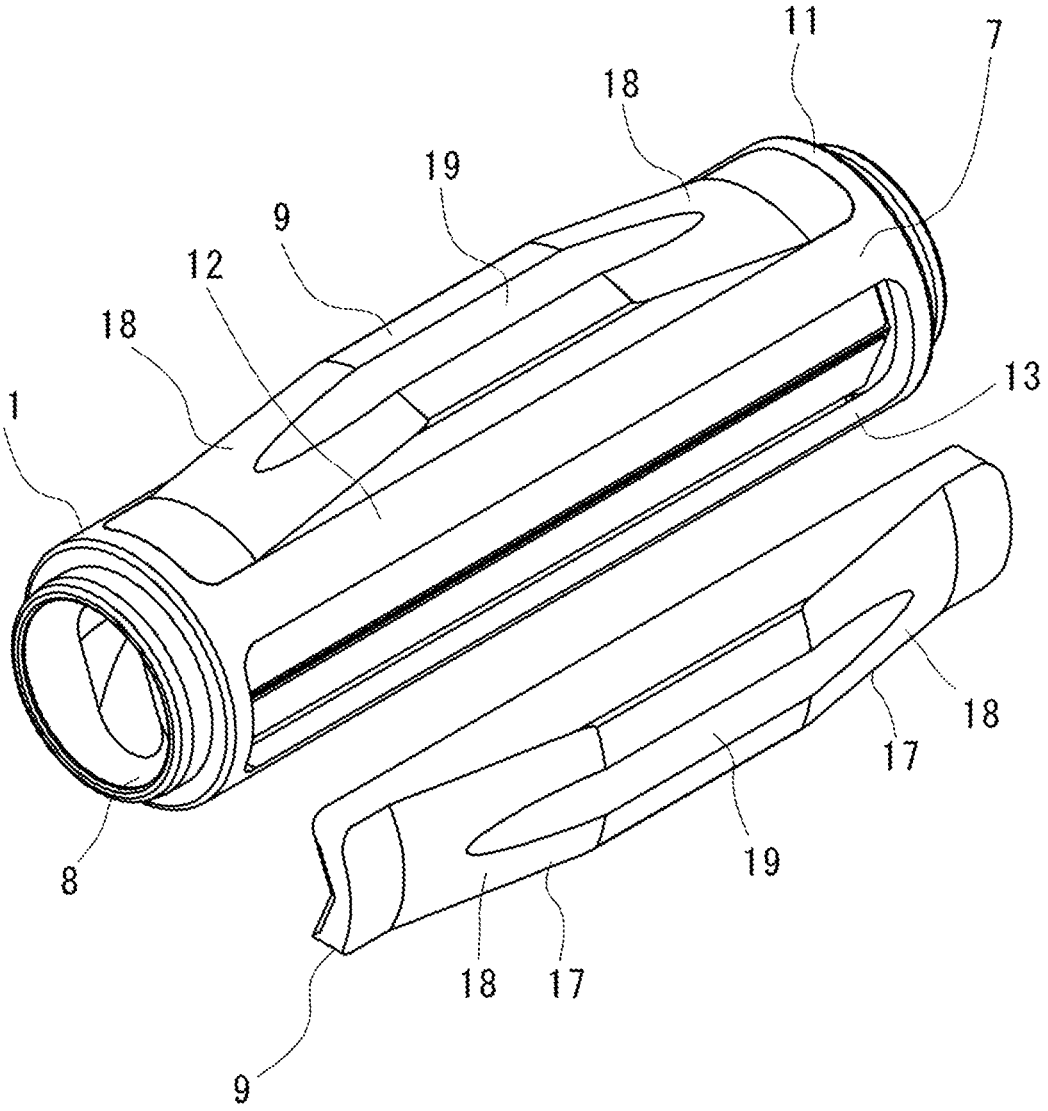
FIG. 3 is a perspective view showing a state in which a guide part is removed from FIG. 2 and one shim is removed.

The outer cylinder 7 is made of a metal material such as stainless steel, and includes annular parts 11 at both end parts and a plurality of (here, four) coupling parts 12 that connect the annular parts 11 to each other as shown in FIG. 3. The outer surface of the annular part 11 includes a cylindrical surface. A polygonal (here, octagon) opening part (not illustrated) is formed on the inner surface side of the annular part 11. The coupling parts 12 are provided at equal intervals in the circumferential direction, and a rectangular hole 13 surrounded by the annular part 11 is formed between the coupling parts 12. The shims 9 are arranged in each rectangular hole 13. The rectangular hole 13 blocks the shim 9 from moving in the circumferential direction about the axis. The outer surface of each coupling part 12 includes an arc surface along the outer surface of the annular part 11. The inner surface of each coupling part 12 is located radially outside the opening part.

Figure 4:
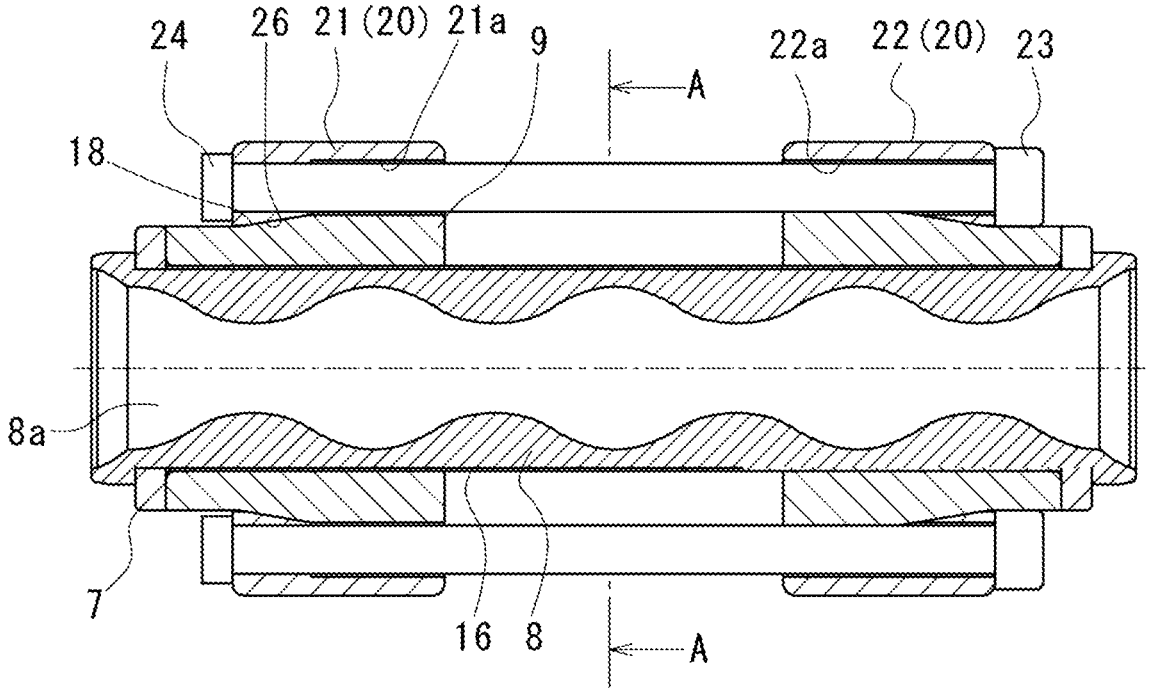
FIG. 4 is a cross-sectional view of the pump body of FIG. 2.
Figure 5:
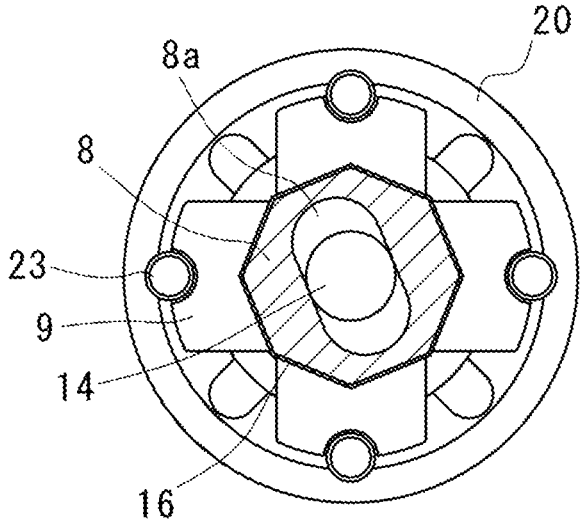
FIG. 5 is a cross-sectional view taken along the line A-A of FIG. 4.

As shown in FIG. 4, the stator 8 has a hollow tubular shape extending from one end toward the other end, and includes an elastic material (e.g., silicon rubber or fluororubber) such as rubber or resin appropriately selected according to a fluid to be conveyed. The outer surface of the stator 8 is formed in a circular shape at both end parts, a polygonal shape in other parts, here a regular octagon in cross section (see FIG. 5). This gives eight outer side surfaces in a part formed to have a regular octagonal cross section. The outer cylinder 7 is attached to the outer surface side of the stator 8. In this attachment state, both end parts of the stator 8 are positioned on both end sides from the annular part 11 of the outer cylinder 7, and both end parts of the outer side surface of the stator 8 are positioned and guided in the opening part of the outer cylinder 7. A through hole 8*a* of the stator 8 has a single-stage or multi-stage female screw shape with n threads. The rotor 14 that is rotationally driven by power transmitted through the joint part 3 by a drive source (not illustrated) is inserted into the through hole 8*a*. The rotor 14 includes a shaft body made of a metal material such as stainless steel into a single-stage or multi-stage male screw shape with n−1 threads. The rotor 14 is disposed in the through hole 8*a* of the stator 8, thereby forming a longitudinally connected conveyance space 15 (see FIG. 1).

As shown in FIG. 3, the shim 9 includes a metal material formed into a rectangular shape in plan view. The shim 9 is attached to each rectangular hole 13 of the outer cylinder 7 without any interval. Due to this, the shims 9 are arranged in a range from one end to the other end of the stator 8. The inner surface of each shim 9 includes two inner side surfaces (planar part) in surface contact with two outer side surfaces of the eight outer side surfaces of the stator 8 via a V-shaped resin plate 16. The four inner surfaces of the shims 9 cover the entire outer side surface of the stator 8 having an octagonal cross section. The outer surface of each shim 9 is provided with an inclined part 17 whose thickness gradually increases toward the center part except for the both end parts. A first inclined surface and a second inclined surface, i.e., a press receiving surfaces 18 are formed on the both end sides of the shim 9 by the inclined part 17. A relief groove 19 extending along the widthwise center line is formed on the outer surface of each shim 9 from the center part to both inclined parts 17. The relief groove 19 is for avoiding interference with a bolt 23 described later. In each shim 9, in a state of being disposed in the rectangular hole 13 of the outer cylinder 7, the outer surfaces of the both end parts are arc surfaces along the outer surface of the outer cylinder 7, and the center part and a part of the inclined part 17 are arc surfaces protruding radially outward from the outer cylinder 7.

As shown in FIGS. 1, 2, and 4, the adjustment member 10 includes a pair of guide parts 20 (first guide part 21 and second guide part 22) disposed on both sides of the outer cylinder 7, and a bolt 23 and a nut 24, which are adjustment parts that adjust the interval between the guide parts 20. The guide part 20 includes a metal material such as stainless steel formed into a cylindrical shape. In the first guide part 21, screw holes 21*a* are formed at four circumferential locations equally. A through hole 22*a* is formed in the second guide part 22. The bolt 23 is inserted into the through hole 22*a* and is screwed into the screw hole 21*a*. On the inner peripheral surface of the guide part 20, a relief recess part 25 is formed at a position corresponding to each coupling part 12 of the outer cylinder 7. The relief recess part 25 is for avoiding interference with a stay bolt (not illustrated) that couples the casing 1 with the end stud 6. A pressing surface 26 (corresponds to the pressing part of the present invention) whose inner diameter dimension gradually decreases toward the end surface side is formed on the inner peripheral surface of the guide part 20. The pressing surface 26 presses the press receiving surface 18 of the shim 9 to move the shim 9 toward the inner diameter side.

The pump body 2 according to the first embodiment is assembled as follows.

The outer cylinder 7 is attached to the stator 8. One end part of the stator 8 is inserted from the annular part 11 on one end side of the outer cylinder 7 while being elastically deformed, and this one end part protrudes from the annular part 11 on the other end side of the outer cylinder 7, whereby the annular parts 11 on the both end parts of the outer cylinder 7 are held between the both end parts of the stator 8.

The shim 9 is disposed in each rectangular hole 13 of the outer cylinder 7. Then, the first guide part 21 is mounted from one end side of the stator 8, the outer cylinder 7, and the shim 9. The second guide part 22 is mounted from the other end side of the stator 8, the outer cylinder 7, and the shim 9. The first guide part 21 and the second guide part 22 are coupled as follows. That is, the bolt 23 is inserted into the through hole 22*a* of the second guide part 22, and this bolt 23 is screwed into the screw hole 21*a* of the first guide part 21 to protrude toward the outer surface side of the first guide part 21. Furthermore, the nut 24 is screwed to the bolt 23 protruding to the outer surface side of the first guide part 21, thereby preventing loosening. The clamping position of the bolt 23 is a position (reference position) where the pressing surface 26 of the guide part 20 comes into contact with the press receiving surface 18 of the shim 9 and does not press the shim 9 to move toward the inner diameter side.

In the pump body 2 according to the first embodiment, the clamping state of the stator 8 is adjusted as follows.

The bolt 23 is tightened to narrow the interval between the guide parts 20. The pressing surface 26 of the guide part 20 presses the press receiving surface 18 of the shim 9, and the shim 9 moves toward the inner diameter side. The inner side surface of the shim 9 presses the outer side surface of the stator 8. The stator 8 whose outer side surface is pressed clamps the rotor 14 by the inner surface constituting the through hole 8*a*. Conversely, when the bolt 23 is loosened, the interval between the guide parts 20 widens, and the pressing surface 26 of the guide part 20 moves radially outward from the press receiving surface 18 of the shim 9. This relaxes the clamping state of the rotor 14 by the stator 8.

Clamping of the rotor 14 by the stator 8 has an appropriate state depending on the fluid to be conveyed. A fluid having low viscosity is likely to leak from the conveyance space 15. In this case, the bolt 23 is tightened to increase the clamping force of the rotor 14 by the stator 8, thereby preventing leakage of the fluid. On the other hand, a fluid having high viscosity does not leak even if the bolt 23 is relaxed to loosen the clamping state of the rotor 14 by the stator 8. Thus, the clamping state may be appropriate according to a difference in the type of the fluid to be conveyed, the flow conditions, and the like.

In the pump body 2 whose clamping state has been changed, by rotating the rotor 14, it is possible to convey the fluid by the conveyance space 15 formed between the pump body 2 and the stator 8. Since the entire outer diameter side of the stator 8 is uniformly pressed toward the inner diameter side by the four shims 9, it is possible to achieve appropriate conveyance without leakage of the fluid between the conveyance spaces 15 with a uniform clamping state.

When the stator 8 is worn by use, it is only required to clamp the rotor 14 by the stator 8 by changing the tightening position of the nut 24 with respect to the bolt 23 and pressing the stator 8 by the shim 9 in the same manner as described above. This makes it possible to suppress deterioration of the flowing state due to wear of the stator 8. When conveying a high-temperature fluid, it is only required to loosen the bolt 23 to suppress the pressing of the stator 8 by the shim 9, and to loosen the clamping of the rotor 14 by the stator 8. Furthermore, when conveying a low-temperature fluid, it is only required to tighten the bolt 23 to press the stator 8 by the shim 9, and to clamp the rotor 14 by the stator 8.

According to the pump body 2 of the first embodiment, the following effects can be obtained.

(1) By changing the screwing position of the nut 24 with respect to the bolt 23, it is possible to linearly adjust the interference between the stator 8 and the rotor 14. That is, it is possible to finely adjust the interference between the stator 8 and the rotor 14 to achieve an appropriate conveyance state according to the type of the fluid.

(2) It is possible to provide a simple and inexpensive configuration in which the tightening position of the nut 24 with respect to the bolt 23 is changed, the interval between the guide parts 20 is adjusted, and the shim 9 is moved radially by the guide part 20. In spite of such a simple and inexpensive configuration, it is possible to freely adjust the interference between the stator 8 and the rotor 14. As a result, it is possible to adjust the interference between the stator 8 and the rotor 14 without requiring a special configuration such as equipment for externally introducing a fluid such as air.

(3) Although it is necessary to form the plurality of rectangular holes 13 in the outer cylinder 7 and newly form the shims 9 arranged in the rectangular holes, it is possible to use the rotor 14 and the stator 8 of standard configuration. Therefore, it is unnecessary to change much of the design of the existing pump body 2.

(4) The shim 9 can press the entire outer surface of the stator 8 by the inner surface of the shim. This makes it possible to uniformly clamp the rotor 14 by the stator 8, and to prevent local deformation of the stator 8. As a result, it is possible to prevent the conveyance performance of the uniaxial eccentric screw pump from deteriorating due to leakage of the fluid between the conveyance spaces 15.

(5) When the stator 8 is worn by use and the clamping state cannot be adjusted only by the shim 9, only the stator 8 must be replaced. Since other members such as the outer cylinder can be used as they are, the cost will not increase.

(6) The shim 9 covers the entire outer surface of the stator 8, and each guide part 20 of the adjustment member 10 guides the stator 8 in the radial direction. Therefore, even when the conveyance space 15 has a high pressure, it is possible to reliably prevent the stator 8 from being deformed radially outward. As a result, it is possible to suppress a decrease in the conveyance capability of the fluid due to deformation of the stator 8.

(7) Regardless of the difference in size of the uniaxial eccentric screw pump, it is only necessary to change the tightening positions of the bolts 23 and the nuts 24 provided at four locations, and it is possible to adjust the interference between the stator 8 and the rotor 14 while eliminating the need for other adjustment.

Although not specifically mentioned in the description of the first embodiment, a scale may be formed in the outer cylinder 7 or the shim 9 along the axial direction. The scale can be configured by a line extending orthogonally to the axial direction for each predetermined dimension or by changing the color. The scale may be formed at a position not covered by the guide part 20, the position opposite to the press receiving surface 18. This makes it possible to adjust the position of each guide part 20 while viewing the scale, and to accurately align the position to a desired position.

In the first embodiment, the bolt 23 and the nut 24 are tightened manually, but they may be tightened automatically by a driving means such as a motor (not illustrated).

Second Embodiment

Figure 6:
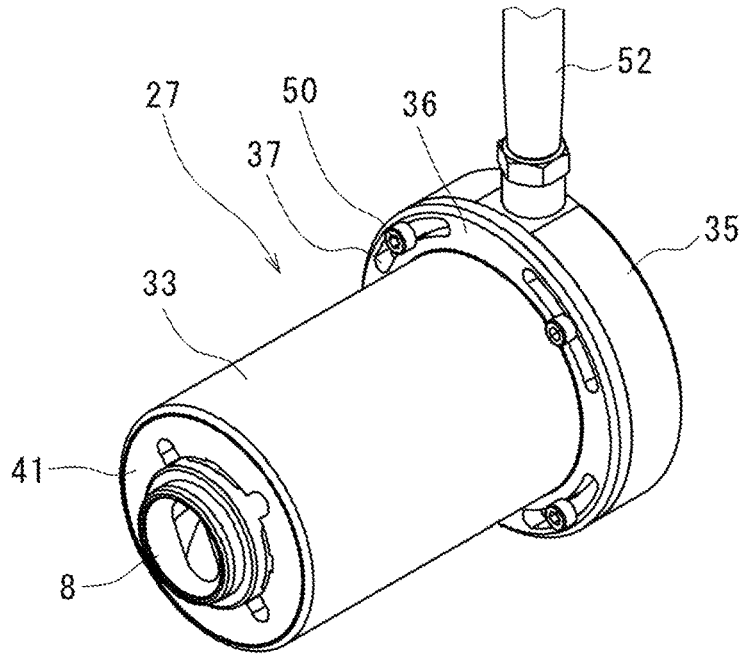
FIG. 6 is a perspective view of a pump body according to a second embodiment.

FIG. 6 shows a pump body 27 of a uniaxial eccentric screw pump according to the second embodiment. The pump body 27 is different from the pump body 2 according to the first embodiment in the following points. Therefore, the same members are denoted by the same reference symbols, and the description thereof will be omitted.

Figure 7:
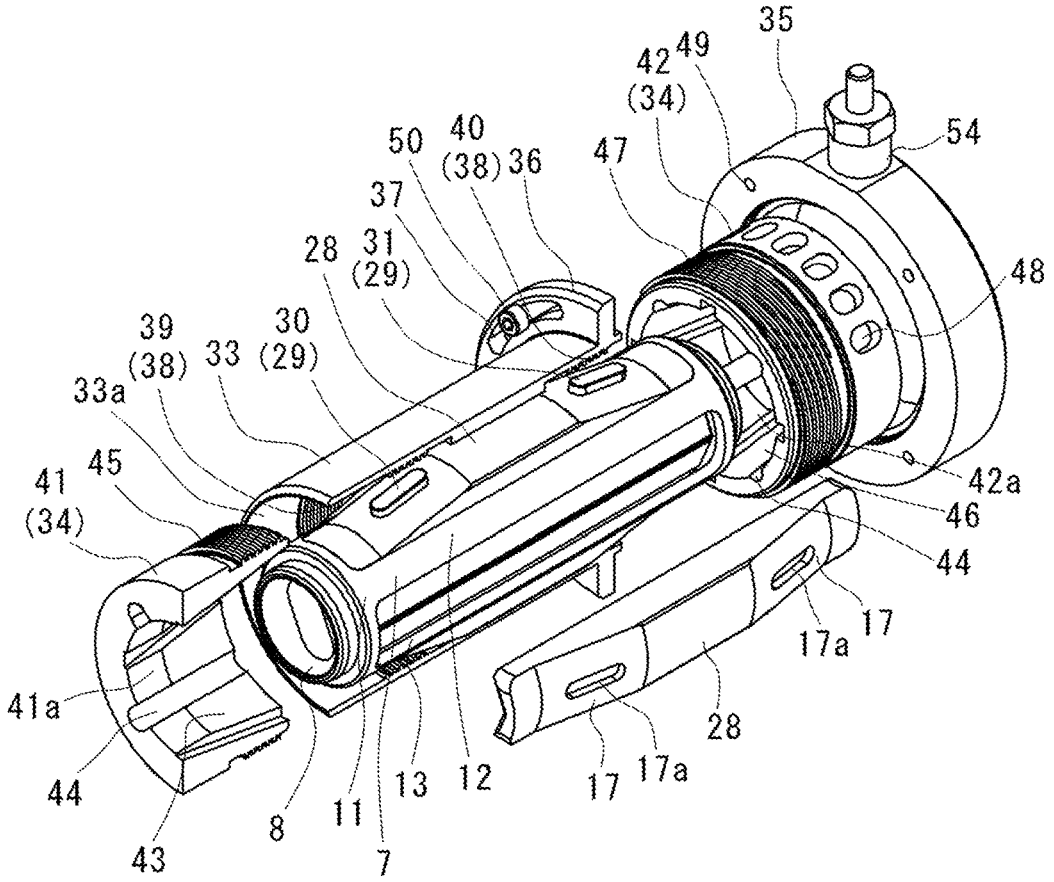
FIG. 7 is a partially exploded perspective view of FIG. 6.
Figure 9:
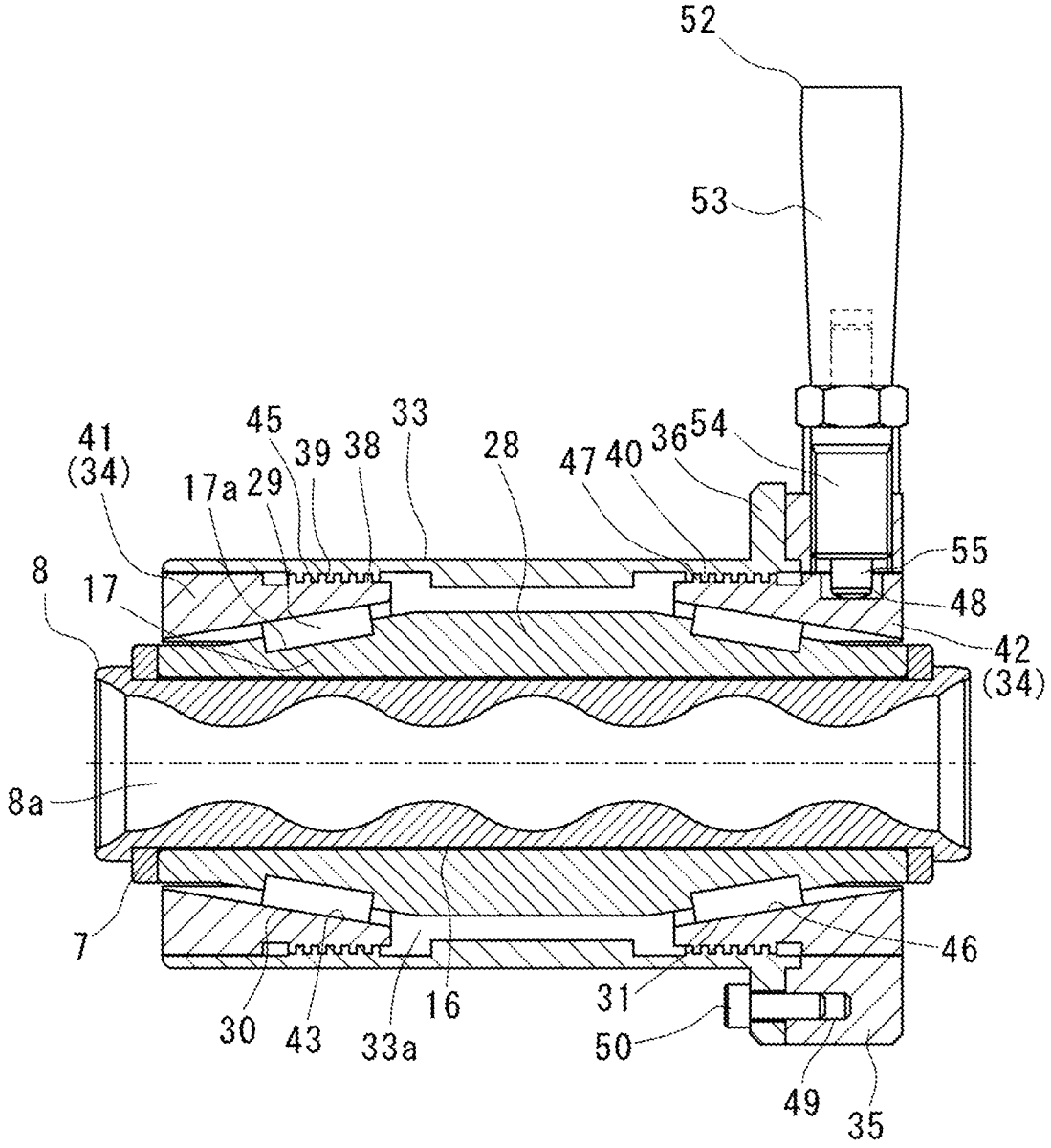
FIG. 9 is a cross-sectional view taken along the line B-B of FIG. 8.

As shown in FIGS. 7 and 9, a shim 28 has substantially the same configuration as that of the first embodiment, but is different in that a longitudinally extending recess part 17*a* is formed at the center of the inclined parts 17 on both sides, and a parallel key 29 is mounted to each recess part 17*a*. An exposed surface of the parallel key 29 on one end side of the shim 28 is a first press receiving surface 30, and an exposed surface of the parallel key 29 on the other end side is a second press receiving surface 31.

An adjustment member 32 is made of a metal material such as stainless steel, and includes a sleeve 33 as an adjustment part, a guide part 20, and an adapter 35.

The sleeve 33 has a hollow tubular shape, and a flange part 36 is formed at one end thereof. In the flange part 36, arc holes 37 are formed at four circumferential locations equally. Each arc hole 37 is formed, for example, in a range of 45° in the circumferential direction about the axial center of the sleeve 33 (see FIG. 8). A female screw part 38 is formed on each inner peripheral surface of both end parts of a center hole 33*a* of the sleeve 33. A first female screw part 39 formed on the inner peripheral surface on the side opposite to the flange part 36 is formed from a position inside from the end surface by a predetermined dimension to a further deeper side. A second female screw part 40 formed on the inner peripheral surface on the flange part side is formed from the end surface toward the deep side. The first female screw part 39 and the second female screw part 40 are formed in opposite directions (e.g., when the first female screw part 39 is a right-handed screw, the second female screw part 40 is a left-handed screw).

The guide part 20 has a hollow tubular shape and includes a first guide part 41 inserted into one end side of the sleeve 33 and a second guide part 42 inserted into the other end side of the sleeve 33.

A center hole 41*a* of the first guide part 41 is formed to have a predetermined inner diameter dimension from one end to a deep side by a predetermined dimension, and is formed therefrom in a tapered shape in which the inner diameter dimension gradually increases toward the other end. The tapered inner peripheral surface constitutes a first pressing surface 43. In the center hole 41*a* of the first guide part 41, relief grooves 44 extending from one end toward the other end are formed at four circumferential locations equally. Similarly to the relief recess part 25 of the first embodiment, the relief groove 44 is for avoiding interference with a stay bolt (not illustrated) that couples the casing with the end stud 6. A first male screw part 45 is formed on the outer peripheral surface on one end side of the first guide part 41. The first guide part 41 is inserted into the center hole 33*a* from one end side of the sleeve 33, and the first male screw part 45 is screwed into the first female screw part 39.

A center hole 42*a* similar to that of the first guide part 41 is also formed in the second guide part 42, and the tapered inner peripheral surface is a second pressing surface 46. The relief groove 44 similar to the above is formed on the inner peripheral surface constituting the center hole 42*a*. On the outer peripheral surface of the second guide part 42, a second male screw part 47 and a plurality of engagement holes 48 are formed in each region divided into two in the axial center direction. The first male screw part 45 and the second male screw part 47 are formed in opposite directions. The second male screw part 47 of the second guide part 42 is screwed into the second female screw part 40 that is formed on the other end side of the center hole 33*a* of the sleeve 33. The plurality of engagement holes 48 are formed at predetermined pitches in the circumferential direction (see FIG. 8). Here, the engagement holes 48 are formed at seven locations. The engagement hole 48 positioned at the center is a reference position SP, and the engagement holes 48 are formed at three positions at equal pitches in one circumferential direction (forward rotational direction), i.e., a first clamping position CP1, a second clamping position CP2, and a third clamping position CP3. The engagement holes 48 are further formed at three positions at equal pitches in the opposite circumferential direction, i.e., a first relax position RP1, a second relax position RP2, and the third relax position RP3. The adjacent engagement hole 48 is at a position rotated about the axis of the second guide part 42 by about 20° in the circumferential direction.

The adapter 35 has an annular shape, and first screw holes 49 are formed at four circumferential locations equally on one end surface. A bolt 50 inserted into the arc hole 37 formed in the flange part 36 of the sleeve 33 is screwed into each first screw hole 49. By tightening the bolt 50 screwed into the first screw hole 49, the sleeve 33 and the adapter 35 are coupled and become integrally rotatable.

Figure 8:
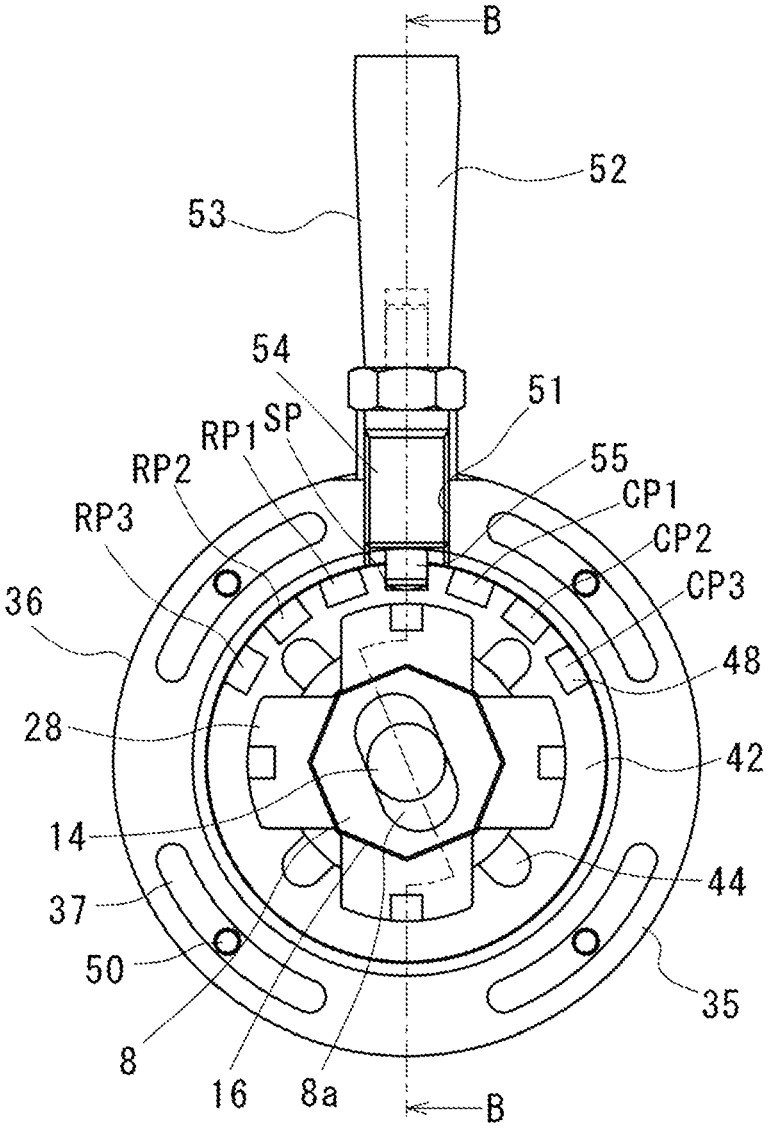
FIG. 8 is a side view of FIG. 6.

As shown in FIG. 8, a second screw hole 51 opening to the inner peripheral surface is formed on the outer peripheral surface of the adapter 35, and a lever 52 is attached thereto. The lever 52 includes a grip part 53 that can be gripped by hand and an attachment part 54 screwed into the second screw hole 51. An engagement projection part 55 is provided at the center part of the tip end surface of the attachment part 54. The engagement projection part 55 is biased in the inner diameter direction by a spring (not illustrated) and can be pulled out by an external force.

The adapter 35 is disposed radially outside the second guide part 42 in a state of being integrated with the sleeve 33. Due to this, when the grip part 53 is gripped and the lever 52 is revolved, the adapter 35 rotates circumferentially together with the sleeve 33 on the radially outside of the second guide part 42. At this time, by revolving the lever 52 while pulling it in the protruding direction, the engagement projection part 55 is retracted into the attachment part 54 and falls off from the engagement hole 48 at the reference position. When the hand is released from the lever 52 after revolving, the engagement projection part 55 again protrudes in the inner diameter direction by the biasing force of the spring, and the engagement position is changed to the adjacently positioned engagement hole 48. When the lever 52 is rotated forward to rotate forward the adapter 35 and the sleeve 33, the engagement projection part 55 changes the engagement position to each engagement hole 48 at the first clamping position CP1, the second clamping position CP2, and the third clamping position CP3. When the lever 52 is rotated backward to rotate backward the adapter 35 and the sleeve 33, the engagement projection part 55 changes the engagement position to each engagement hole 48 at the first relax position RP1, the second relax position RP2, and the third relax position RP3. The adapter 35 rotated by the lever 52 is a rotation part, and the engagement projection part 55 of the lever 52, i.e., the positioning projection part and each engagement hole 48 of the second guide part 42, i.e., the positioning recess part are the positioning parts, and constitute the rotational position regulation portion as a whole.

The pump body 27 according to the second embodiment is assembled as follows.

Similarly to the first embodiment, the outer cylinder 7 is attached to the stator 8, and the shim 28 is attached to the rectangular hole 13 of the outer cylinder 7.

After the parallel key 29 is attached to each recess part 17*a* of the shim 28, the sleeve 33 is disposed radially outside the stator 8 in which the outer cylinder 7 and the shim 28 are integrated. In this state, the first guide part 41 is inserted from one end side of the sleeve 33, and the first male screw part 45 is screwed into the first female screw part 39. The second guide part 42 is inserted from the other end side of the sleeve 33, and the second male screw part 47 is screwed into the second female screw part 40. These screwing positions are preferably center positions that can rotate while maintaining the screwing state in any direction.

The adapter 35 is disposed radially outside the second guide part 42. The sleeve 33 and the adapter 35 are integrated by inserting the bolt 50 into the arc hole 37 formed in the flange part 36 of the sleeve 33 and screwing the bolt 50 into the first screw hole 49 of the adapter 35. At this time, the circumferential position of the adapter 35 can be adjusted using the arc hole 37. The attachment part 54 of the lever 52 is screwed into the second screw hole 51 of the adapter 35. Due to this, the engagement projection part 55 protruding from the tip end surface of the attachment part 54 engages with the engagement hole 48 of the second guide part 42. Finally, the rotor 14 is inserted into the through hole 8*a* of the stator 8, and the assembly work of the pump body 2 is completed.

In the pump body 27 according to the second embodiment, the clamping state of the stator 8 is adjusted as follows.

The adapter 35 is circumferentially rotated while gripping the lever 52 and pulling the lever in the protruding direction. The engagement projection part 55 of the lever 52 falls off from the engagement hole 48 of the second guide part 42, and the adapter 35 rotates together with the sleeve 33. The rotation of the sleeve 33 changes the screwing positions of the first male screw part 45 of the first guide part 41 and the second male screw part 47 of the second guide part 42, which are respectively screwed into the first female screw part 39 and the second female screw part 40.

When the lever 52 is rotated forward, the adapter 35 and the sleeve 33 are also rotated forward. This causes the first guide part 41 and the second guide part 42 to move in a direction where they simultaneously approach each other. By the movement of the first guide part 41 and the second guide part 42, the first pressing surface 43 of the first guide part 41 presses the first press receiving surface 30 of the shim 9, and the second pressing surface 46 of the second guide part 42 presses the second press receiving surface 31 of the shim 9.

The shim 9 uniformly moves radially inward due to the first press receiving surface 30 and the second press receiving surface 31 being pressed simultaneously. The movement of the shim 9 presses and compresses the outer surface of the stator 8 with the inner surface of the shim 9. This strengthens the clamping state of the stator 8 with respect to the rotor 14.

When the lever 52 is rotated backward, the adapter 35 and the sleeve 33 are also rotated backward. This causes the first guide part 41 and the second guide part 42 to move in a direction where they simultaneously separate from each other. By the movement of the first guide part 41 and the second guide part 42, the first pressing surface 43 of the first guide part 41 moves in a direction away from the first press receiving surface 30 of the shim 28, and the second pressing surface 46 of the second guide part 42 moves in a direction away from the second press receiving surface 31 of the shim 28.

When the pressing states of the first press receiving surface 30 and the second press receiving surface 31 are simultaneously released, the shim 28 uniformly moves radially outward by the elastic force of the stator 8. The movement of the shim 28 relaxes the clamping state of the stator 8 with respect to the rotor 14.

According to the pump body 27 according to the second embodiment, the following effects are further achieved in addition to the same effects (1) to (6) as those of the pump body 2 according to the first embodiment.

(8) By accurately and simultaneously moving the first guide part 41 and the second guide part 42 and simultaneously pressing the shim 28 on both end sides, it is possible to uniformly compress the stator 8 and relax the compression state. Therefore, with the uniform clamping state of the rotor 14 by the stator 8, it is possible to prevent leakage of the fluid and appropriately convey the fluid regardless of the difference in position of the conveyance space 15 in the axial center direction.

(9) Simply by operating the rotation of the single lever 52 forward and backward, it is possible to perform both operations of clamping of the rotor 14 by the stator 8 and relaxing thereof.

(10) The rotational position of the sleeve 33 can be accurately set by the engagement between the engagement projection part 55 and the engagement hole 48. Therefore, the condition for clamping the stator 8 via the shim 28 can be accurately adjusted in a plurality of stages.

In the second embodiment, the sleeve 33 is manually rotated, but it may be rotated by a driving means such as a motor (not illustrated).

In the second embodiment, the screwing positions of the first male screw part 45 of the first guide part 41 and the second male screw part 47 of the second guide part 42 screwed into the first female screw part 39 and the second female screw part 40, respectively, are changed by the rotation of the sleeve 33. However, the sleeve 33 and the first guide part 41 may be simply integrated, and only the screwing position of the second male screw part 47 of the second guide part 42 may be changed.

The present invention is not limited to the configuration described in the above embodiments, and various changes are possible.

In the above embodiment, the press receiving surfaces 18, 30, and 31 are configured by the inclined surface gradually inclined radially inward toward both end parts on both end sides of the shim 9, but this inclined surface may be formed at the center part or may be provided only on one end side.

Figure 10:
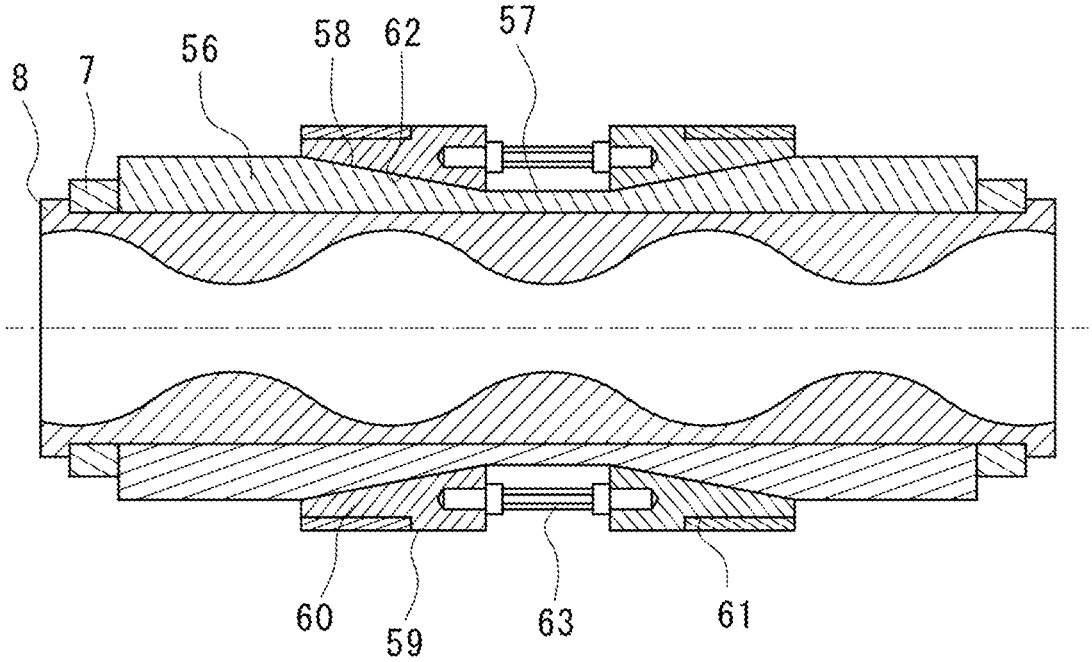
FIG. 10 is a cross-sectional view of a pump body according to another embodiment.

FIG. 10 shows an example in which the inclined surface is formed in the center part. In this example, an annular groove 57 connected circumferentially is formed in the center part of a shim 56. The annular groove 57 includes a deepest circumferential surface formed in the center part, and a conical inclined surface that gradually becomes shallower toward both end sides, i.e., a press receiving surface 58. A guide part 59 is disposed in the annular groove 57. The guide part 59 includes a first guide part 60 and a second guide part 61. Both the first guide part 60 and the second guide part 61 have conical inclined surfaces whose inner diameter dimension gradually increases toward both end sides of the shim 56. This inclined surface is a pressing surface 62. The first guide part 60 and the second guide part 61 are coupled by a double-threaded bolt 63, which is an adjustment part. Screw parts at both ends of the double-threaded bolt 63 are wound in opposite directions (in the drawing, when the left end side of the double-threaded bolt 63 is a right-handed screw, the right end side is a left-handed screw). By rotating the double-threaded bolt 63 forward and backward, it is possible to adjust the interval between the first guide part 60 and the second guide part 61, to compress the stator 8 via the shim 56, and to relax the compression state.

Figure 11:
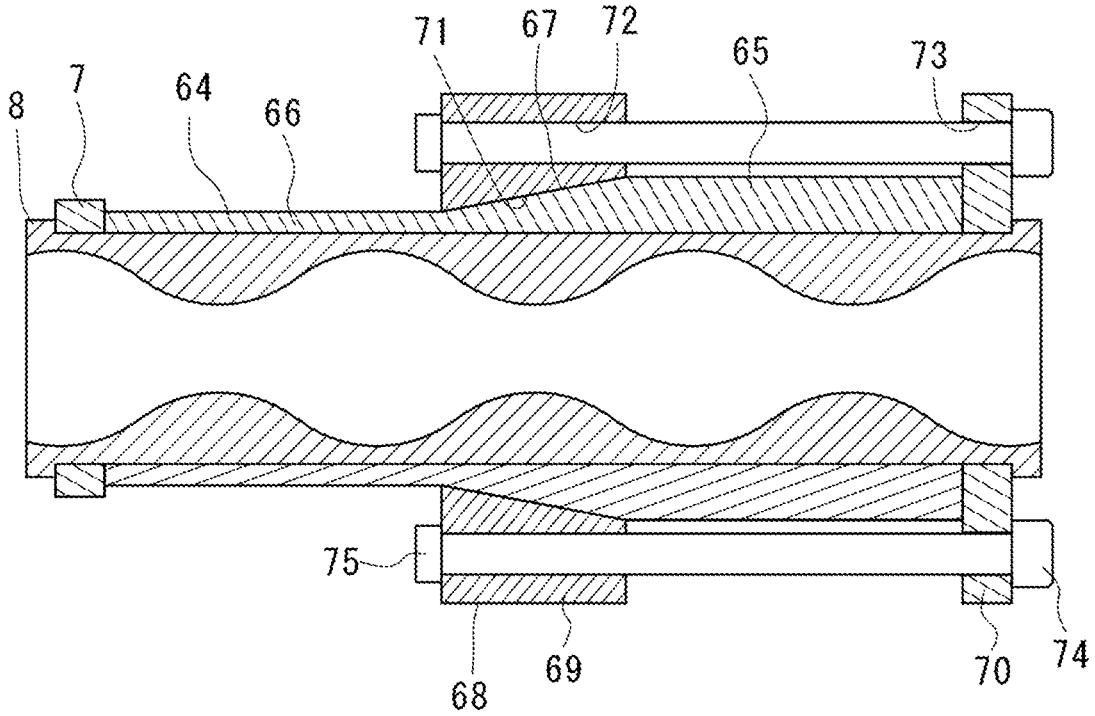
FIG. 11 is a cross-sectional view of a pump body according to another embodiment.

FIG. 11 shows an example in which the inclined surface is formed only at one location of a shim 64. In this example, the shim 64 includes a large-diameter part 65 and a small-diameter part 66. The small-diameter part 66 and the large-diameter part 65 are connected with an inclined surface, and this inclined surface constitutes a press receiving surface 67. A guide part 68 includes a first guide part 69 and a second guide part 70. The first guide part 69 has a hollow tubular shape and includes an inclined surface. This inclined surface is a pressing surface 71. A first through hole 72 is formed equally in the circumferential direction in the outer peripheral part of the first guide part 69. The second guide part 70 is one end part of the outer cylinder 7 protruding toward the outer diameter side, and a second through hole 73 is formed at a position corresponding to the first through hole 72 of the first guide part 69 on the outer peripheral part. A bolt 74 is inserted into the second through hole 73 of the second guide part 70 and inserted into the first through hole 72 of the first guide part 69, and a nut 75 is screwed into the protruding part. By changing the screwing position of the nut 75, it is possible to change the interval between the first guide part 69 and the second guide part 70 to compress the stator 8 via the shim 64 and relax the compression state.

In the above embodiments, the adjustment parts such as the bolts 23 and 74, the nuts 24 and 75, and the double-threaded bolt 63 are provided, but the following configuration can be adopted instead of them.

Figure 12:
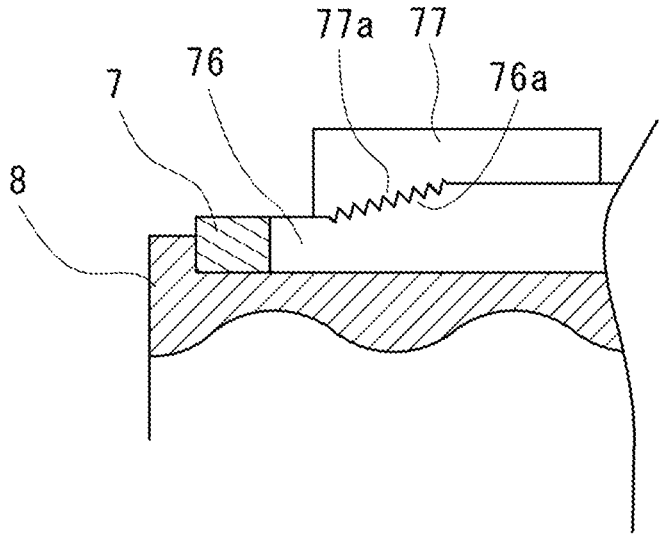
FIG. 12 is a cross-sectional view showing a part of a pump body according to another embodiment.
Figure 13:
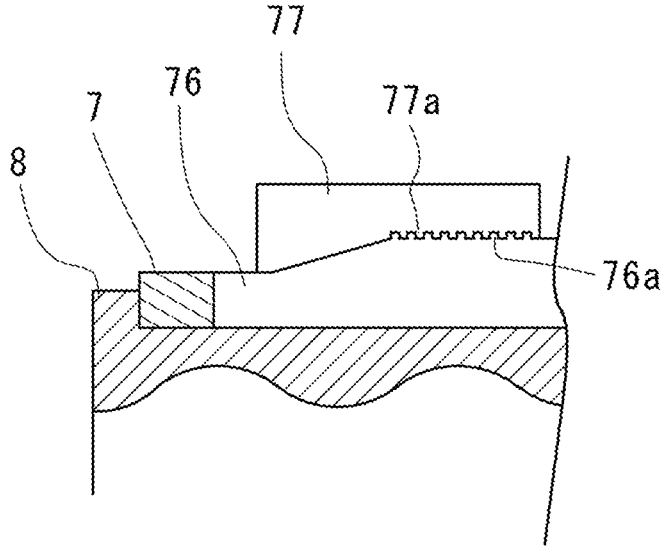
FIG. 13 is a cross-sectional view showing a part of a pump body according to another embodiment.

FIGS. 12 and 13 show an example in which screw parts 76*a* and 77*a* are formed in a shim 76 and a guide part 77. In FIG. 12, the screw parts 76*a* and 77*a* are formed on inclined surfaces of the shim 76 and the guide part 77. In FIG. 13, the screw parts 76*a* and 77*a* are formed on outer peripheral surfaces. According to these examples, the shim 76 can be moved radially by circumferentially rotating the guide part 77 with respect to the shim 76 and changing the screwing positions of the screw parts 76*a* and 77*a*.

In the above embodiments, the pressing state of the shim 9 by the guide part 20 is changed by a single adjustment member to adjust the compression state of the stator 8. However, the compression state of the stator 8 may be adjusted at a plurality of locations.

Figure 14:
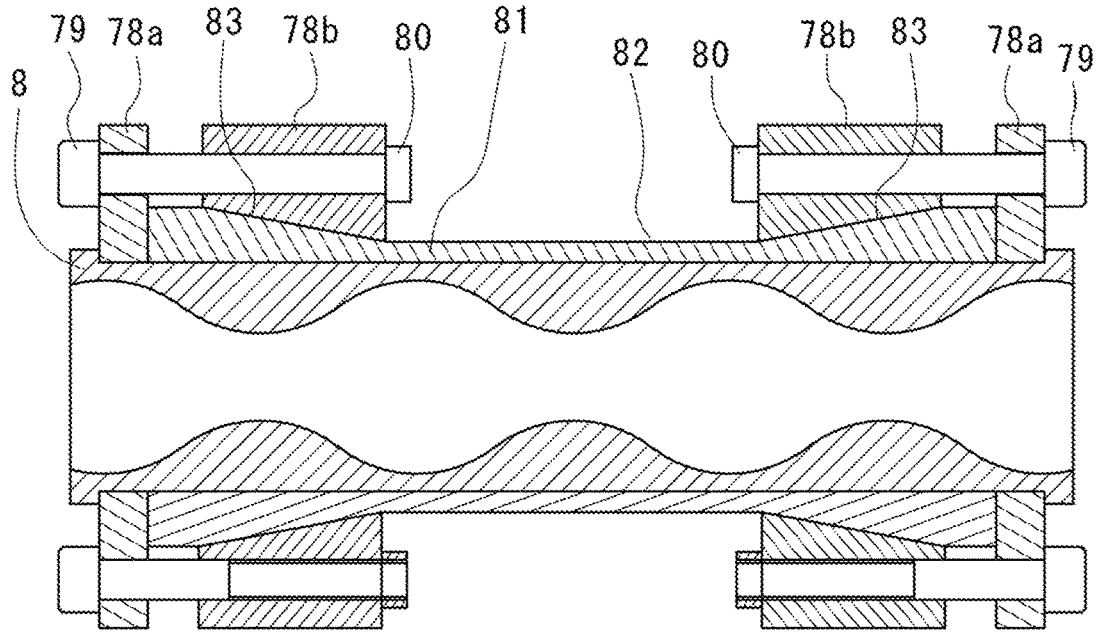
FIG. 14 is a cross-sectional view of a pump body according to another embodiment.

In FIG. 14, a guide part 78*a* protruding to the outer diameter side is formed at each of both end parts of the outer cylinder 7, a guide part 78*b* having a hollow tubular shape is disposed around the outer cylinder 7 with respect to each guide part 78*a*, and the guide part 78*a* and the guide part 78*b* are tightened by a bolt 79 and a nut 80. The configuration of the shim 81 is substantially the same as that shown in FIG. 10, but the width of an annular groove 82 is wide, and a press receiving surface 83, which is an inclined surface, is positioned away from both end sides. By changing the tightening position of the bolt 79 and the nut 80, it is possible to bring the guide part 78*a* and the guide part 78*b* into and out of contact with each other. Note that each guide part 78*b* may be gripped by an actuator (not illustrated) to be individually brought into and out of contact with each guide part 78*a*.

Figure 15:
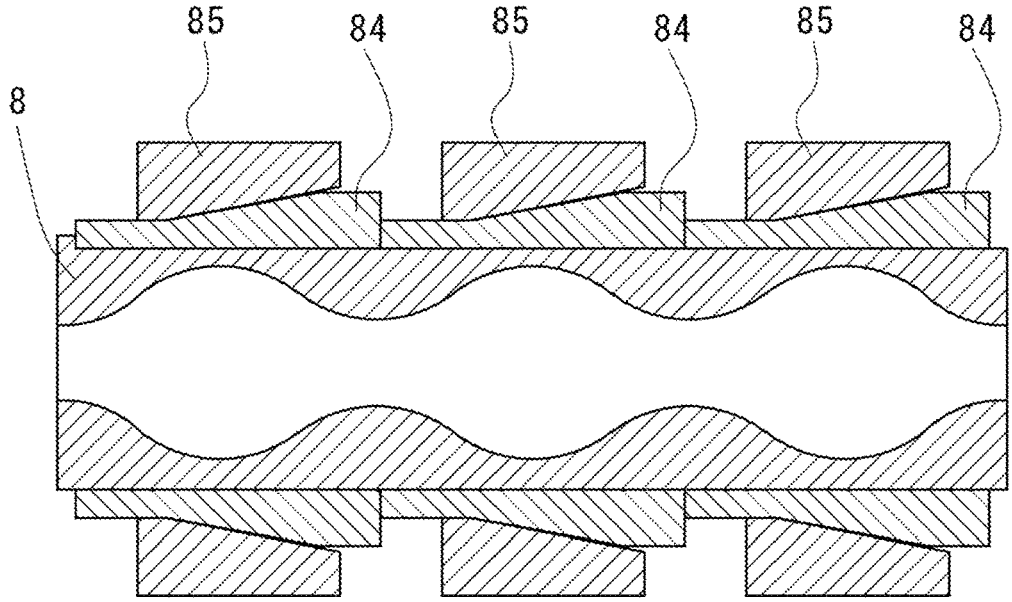
FIG. 15 is a cross-sectional view of a pump body according to another embodiment.

In FIG. 15, a shim 84 and a guide part 85 are individually arranged at a total of three positions, i.e., both end parts and the center part. In this case, the configuration shown in FIGS. 12 and 13 can be adopted for movement of the shim 84 by the guide part 85.

According to the configuration shown in FIGS. 14 and 15, the compression state of the stator 8 can be individually adjusted at a plurality of locations in the axial direction. Therefore, it is possible to obtain an appropriate compression state according to the difference in conditions such as the pressure received from the fluid at each location and the worn state of the stator 8.

In each of the above embodiments, the outer cylinder 7 is provided on the radially outside. However, it is also possible to adopt a configuration in which only the shims 9, 28, 56, 64, 76, and 81 are arranged without requiring the outer cylinder 7.

DESCRIPTION OF SYMBOLS

1 Casing
2 Pump body
3 Joint part
4 Connection pipe
5 Drive shaft
6 End stud
7 Outer cylinder
8 Stator
9 Shim
10 Adjustment member
11 Annular part
12 Coupling part
13 Rectangular hole
14 Rotor
15 Conveyance space
16 Resin plate
17 Inclined part
18 Press receiving surface
19 Relief groove
20 Guide part
21 First guide part
22 Second guide part
23 Bolt
24 Nut
25 Relief recess part
26 Pressing surface
27 Pump body
28 Shim
29 Parallel key
30 First press receiving surface
31 Second press receiving surface
32 Adjustment member
33 Sleeve
34 Guide part
35 Adapter
36 Flange part
37 Arc hole
38 Female screw part
39 First female screw part
40 Second female screw part
41 First guide part
42 Second guide part
43 First pressing surface
44 Relief groove
45 First male screw part
46 Second pressing surface
47 Second male screw part
48 Engagement hole
49 First screw hole
50 Bolt
51 Second screw hole
52 Lever
53 Grip part
54 Attachment part
55 Engagement projection part
56 Shim
57 Annular groove
58 Press receiving surface
59 Guide part
60 First guide part
61 Second guide part
62 Pressing surface
63 Double-threaded bolt
64 Shim
65 Large-diameter part
66 Small-diameter part
67 Press receiving surface
68 Guide part
69 First guide part
70 Second guide part
71 Pressing surface
72 First through hole
73 Second through hole
74 Bolt
75 Nut
76 Shim
77 Guide part
**78*a*, 78*b*** Guide part
79 Bolt
81 Shim
82 Annular groove
83 Press receiving surface
84 Shim
85 Guide part

The invention claimed is:

1. A uniaxial eccentric screw pump comprising:

a stator having a through hole whose inner surface is formed in a female screw shape;

a rotor that is a male screw shaft body inserted into the through hole of the stator;

a plurality of shims that are arranged on a radially outside of the stator in a range from one end to an other end of the stator, are in surface contact with an outer surface of the stator, are capable of compressing the stator by moving radially inward with respect to the stator, and have, on an outer surface, an inclined surface gradually inclined radially inward or outward toward one end; and an adjustment member that is movable in an axial direction with respect to the stator and has a pressing part that can press the inclined surface of each of the shims, wherein the incline surface of each of the plurality shims extends in a longitudinal direction of the stator so that at least half of a length of the inclined surface is within an inner side with respect to both of the one end and the other end in the longitudinal direction of the stator.

2. The uniaxial eccentric screw pump according to claim 1 further comprising an outer cylinder that guides each of the shims in a state of blocking the shim from moving in a direction other than a radial direction.

3. The uniaxial eccentric screw pump according to claim 1, wherein the stator is formed to have a polygonal cross section, the shim includes at least one planar part in surface contact with the outer surface of the stator, and the planar part of any of the shims is in surface contact with all outer surfaces of the stator.

4. The uniaxial eccentric screw pump according to claim 1, wherein the inclined surface of the shim includes a first inclined surface of an outer surface on one end side and a second inclined surface of an outer surface on an other end side, and the adjustment member includes a first guide part disposed on one end side of the stator, a second guide part disposed on an other end side of the stator, and an adjustment part that adjusts an interval between the first guide part and the second guide part.

5. The uniaxial eccentric screw pump according to claim 4, wherein the adjustment part simultaneously moves the first guide part and the second guide part in opposite directions to uniformly bring the first guide part and the second guide part into and out of contact with each other.

6. The uniaxial eccentric screw pump according to claim 4, wherein the adjustment part includes a bolt and a nut that clamp the first guide part and the second guide part.

7. The uniaxial eccentric screw pump according to claim 4, wherein the adjustment part is tubular, is disposed on the radially outside of the stator, and includes a right-handed screw and a left-handed screw on an inner peripheral surface of both end parts, and the first guide part and the second guide part include a screw part screwed into the right-handed screw and the left-handed screw on an outer surface of the first guide part and the second guide part, respectively.

8. The uniaxial eccentric screw pump according to claim 7, comprising a rotational position regulation portion that regulates a rotational position of the adjustment part, wherein the rotational position regulation portion includes a rotation part that circumferentially rotates the adjustment part, and a positioning part that positions the rotation part with respect to the first guide part of the second guide part.

9. The uniaxial eccentric screw pump according to claim 8, wherein the positioning part includes a positioning projection part formed on the rotation part, and a positioning recess part formed at a position corresponding to a rotation angle of the rotation part from a reference position in the first guide part or the second guide part, where the positioning projection part is engaged with or disengaged from the positioning projection part.

* * * * *